US009045866B2

(12) United States Patent
Bösterling

(10) Patent No.: US 9,045,866 B2
(45) **Date of Patent: *Jun. 2, 2015**

(54) TENSIONING CLAMP FOR FASTENING A RAIL AND SYSTEM EQUIPPED WITH A TENSIONING CLAMP OF THIS TYPE

(75) Inventor: Winfried Bösterling, Neuenrade (DE)

(73) Assignee: Vossloh-Werke GmbH, Werdohl (DE)

( * ) Notice: Subject to any disclaimer, the term of this patent is extended or adjusted under 35 U.S.C. 154(b) by 580 days.

This patent is subject to a terminal disclaimer.

(21) Appl. No.: 12/939,858

(22) Filed: Nov. 4, 2010

(65) Prior Publication Data

US 2012/0111960 A1 May 10, 2012

(51) Int. Cl.
*E01B 9/30* (2006.01)

(52) U.S. Cl.
CPC ..... *E01B 9/303* (2013.01)

(58) Field of Classification Search
USPC ..... 238/310, 315, 338, 349, 351, 352
See application file for complete search history.

(56) References Cited

U.S. PATENT DOCUMENTS

| | | | | |
|---|---|---|---|---|
| 3,439,874 | A | 4/1969 | Meier | |
| 3,690,551 | A | 9/1972 | Munch | |
| 4,312,478 | A | 1/1982 | Matsuo et al. | |
| 4,632,307 | A | 12/1986 | Weber | |
| 4,705,215 | A * | 11/1987 | Eisenberg et al. | 238/349 |
| 4,907,740 | A | 3/1990 | Oberweiler et al. | |
| 5,096,119 | A | 3/1992 | Schultheiss et al. | |
| 2008/0105758 | A1 * | 5/2008 | Schwiede et al. | 238/349 |
| 2008/0237363 | A1 | 10/2008 | Hauschild et al. | |
| 2009/0084864 | A1 | 4/2009 | Bosterling et al. | |
| 2009/0308943 | A1 * | 12/2009 | Wirthwein et al. | 238/310 |
| 2010/0308123 | A1 | 12/2010 | Bosterling | |
| 2011/0315784 | A1 | 12/2011 | Bosterling et al. | |
| 2012/0111959 | A1 * | 5/2012 | Krieg | 238/349 |

FOREIGN PATENT DOCUMENTS

| | | | |
|---|---|---|---|
| DE | 102007046543 | A1 | 4/2009 |
| EP | 0794290 | A1 | 9/1997 |
| EP | 1116827 | A1 | 7/2001 |
| WO | 8700566 | | 1/1987 |
| WO | 2010076047 | A1 | 7/2010 |

* cited by examiner

*Primary Examiner* — Zachary Kuhfuss
(74) *Attorney, Agent, or Firm* — The Webb Law Firm

(57) ABSTRACT

A tensioning clamp for fastening a rail comprising a centre portion, at least one torsional portion branching off from the centre portion in the lateral direction, at least one transitional portion adjoining the torsional portion, at least one holding arm which is connected to the transitional portion and an end portion of which holding arm associated with a free end of the holding arm is oriented bent in relation to the torsional portion viewed in a plan view of the tensioning clamp, and a bearing region extending over the length of the end portion configured on the bent end portion of the holding arm, wherein the end portion is bent in relation to a part piece of the holding arm adjoining it in such a way that when the tensioning clamp is completely assembled, the bearing region, over its entire length, rests linearly on a rail foot of a rail to be fastened.

16 Claims, 4 Drawing Sheets

TENSIONING CLAMP FOR FASTENING A RAIL AND SYSTEM EQUIPPED WITH A TENSIONING CLAMP OF THIS TYPE

BACKGROUND OF THE INVENTION

1. Field of the Invention

The invention relates to a tensioning clamp for fastening a rail with a centre portion, with at least one torsional portion branching from the centre portion in the lateral direction, with at least one transitional portion adjoining the torsional portion and with at least one holding arm which is connected to the transitional portion and the end portion of which holding arm associated with the free end of the holding arm, viewed in a plan view of the tensioning clamp, is bent to point away from the torsional portion. Tensioning clamps of this type are generally bent in one piece from a spring steel.

The invention also relates to a system for fastening a rail, which has a rail foot, a web standing thereon and a rail head, with a guide plate, a tensioning clamp held on the guide plate and a tensioning means for bracing the tensioning clamp against a base supporting the rail.

2. Description of the Related Art

A tensioning clamp and a system of this type are known from DE 10 2007 046 543 A1. In the known system, a tensioning clamp is used as the spring element for producing the resiliently elastic holding force required to hold down the rail, and, taking into account the length of the carrier plate measured in the longitudinal direction of the rail to be fastened, is designed in such a way that its at least one holding arm can cover maximum spring paths. In this case, the end portion of the holding arm is bent to point away from the torsional portion in such a way that, in the assembly position, it points in the direction of the web of the rail to be fastened. Owing to this measure, on the one hand, the closely limited support region formed on the free tip of the respective end portion, in which the holding arm with its end portion exerts the required holding down force on the rail foot during use, is displaced from the edge of the rail foot in the direction of the rail web of the rail to be fastened. This ensures that the required holding force is also constantly perfectly transmitted by the respective holding arm onto the rail foot when the rail foot, as a consequence of the transverse forces occurring when the rail is traveled over and a lateral support, which is imprecise under some circumstances, on the carrier plate, moves excessively strongly transverse to the longitudinal direction thereof. Moreover, the displacement of the support region in the direction of the rail web brings about a higher resistance against an undesired rotation, so the positionally correct assembly of the tensioning clamp, in particular, is facilitated.

Practical experiences with the system described above show that owing to the bent shaping of the end portions of the holding arms of the tensioning clamp, even when there is a relatively large transverse displacement, the secure hold of the rail is ensured. However, in particular when the rail carries out alternating short transverse movements, when a rail vehicle travels over it, increased abrasive wear occurs in the region of the areas, in which the end portions of the holding arms act on the rail foot of the rail to be fastened. Moreover, the special shaping of the tensioning clamp used in the known system described above proves to be advantageous with regard to a maximum elasticity of the spring. But it is difficult with this shaping, with limited installation space and comparably limited tensioning paths, to exert high spring forces on the rail foot.

SUMMARY OF THE INVENTION

Against the background of the state of the art described above, the invention was based on the object of providing a tensioning clamp and a system for fastening a rail, in which, with further improved operating safety, the danger of excessive wear in the region in which the tensioning clamp acts on the rail to be fastened is reduced.

In relation to a tensioning clamp, this object is achieved according to the invention in that a tensioning clamp of this type has the features disclosed herein.

In relation to a system for fastening a rail, the solution according to the invention to the above disclosed object consists in that a system of this type comprises a tensioning clamp configured according to the invention.

Advantageous configurations of the invention are disclosed in the dependent claims and, like the general concept of the invention, will be described in detail below.

A tensioning clamp according to the invention for fastening a rail, in agreement with the prior art described at the outset, has a centre portion, a torsional portion branching off from the centre portion in the lateral direction, at least one transitional portion adjoining the torsional portion and at least one holding arm connected to the transitional portion. In this case, the end portion of the holding arm associated with the free end of the holding arm, viewed in a plan view, is oriented bent away from the torsional portion.

According to the invention, a bearing region extending over the length of the end portion is now formed on the bent end portion of the holding arm. At the same time, the end portion is bent according to the invention in relation to the part piece of the holding arm adjoining it in such a way that, when the tensioning clamp is completely assembled, the bearing region rests linearly over its length on the associated surface of the rail foot of the rail to be fastened.

In a tensioning clamp according to the invention, the end portion present on the respective holding arm, in the installed position, is not only bent pointing to the rail web or away from the rail web in the direction of the torsional portion of the tensioning clamp, but an enlarged bearing face is additionally provided in the region of the respective end portion, by means of which bearing face the surface pressures acting between the rail foot and end portion when the tensioning clamp is braced are reduced. As a result, the danger is minimised of excessive abrasive wear occurring in the region of contact between the rail and the tensioning clamp. In this case, the invention proceeds from the recognition that in the prior art described at the outset, intensive working in occurs in the region of the contact face because the contact face is limited to a very small area there, which is also positioned close to the edge of the free end face of the end portion. This danger no longer exists when using a tensioning clamp according to the invention because the respective end portion is formed according to the invention in such a way that, when the tensioning clamp is braced, it is seated substantially over its entire length on the surface of the rail foot of the rail to be fastened.

Since a linear contact with the associated surface of the rail foot exists over the length of the bearing region of the respective end portions present on the tensioning clamp, the friction area, which is important for the frictional resistance counteracting a transverse movement of the rail, is at the same time so small, however, that the rail can move relative to the tensioning clamp and the other components of the fastening system according to the invention if necessary. Damage to the rail foot by working in of the end of the tensioning clamp acting on the rail foot can thus be effectively prevented.

A further advantage of the configuration according to the invention of a tensioning clamp, which is important in practice, in combination with the other components of a system according to the invention, consists in the fact that it is possible, without problems owing to the linear, elongate contact face extending over the entire length of the relevant end portion and present according to the invention on the at least one end portion, to combine one and the same tensioning clamp with guide plates of different widths in order to regulate the gauge of a track body formed using a rail fastened in the manner according to the invention. The width of the guide plate is measured here transverse to the longitudinal direction of the respective rail. Owing to the elongate bearing face formed on the bent end portion of a tensioning clamp according to the invention, it is ensured, regardless of the respective position of the guide plate, that the required holding down forces are always reliably applied, and with optimally distributed surface pressures, on the rail foot.

The configuration of a tensioning clamp according to the invention, also has the same effect when, as a result of wear, there is a displacement of the rail transverse to its longitudinal extent and relative to the guide plate, on which the tensioning clamp is supported. It is ensured by the long, linear bearing face predetermined according to the invention in the region of the end portion of the tensioning clamp acting on the rail foot, in each case, that adequate holding down forces act on the rail foot even when a gap has formed between the guide plate and the rail foot as a result of wear, which is so great that the end portion acting on the rail foot projects over a part of its length over this gap.

It proves to be particularly advantageous in this context when the end portion, viewed in a plan view of the tensioning clamp, is bent to point away from the torsional portion in such a way that it is directed, in the assembly position, toward the rail web of the rail to be fastened.

With an orientation of this type of the respectively bent end portion, it is ensured with a maximised holding down force and minimised dimensions of the tensioning clamp that the required holding down force is also reliably transmitted when there is no longer a perfect assembly position of the rail, guide plate or tensioning clamp.

A further increase in the holding down force with optimised fatigue strength of the tensioning clamp can be achieved in that, as an alternative, the end portion, viewed in a plan view of the tensioning clamp, is bent to point to the torsional portion in such a way that, in the assembly position, it is directed away from the rail web of the rail to be fastened. So that the respective end portion reliably rests on the rail foot over the entire length of its bearing face despite its orientation pointing to the torsional portion, in this configuration of the invention, the at least one holding arm of the tensioning clamp, on the end of which is configured the respective end portion which is oriented and provided according to the invention with a linear contact face, is longer than in the variant of the invention described in the above paragraphs. This leads to a stronger elasticity of the holding arm and, accompanying this, to a less heavy loading resulting in the fact that its fatigue strength is increased. The smallest spacing here between the end portion configured according to the invention and the associated torsional portion can be used here as the measure of the minimum length of the holding arm. This spacing, when a completely assembled system according to the invention is new, should be greater than the smallest spacing between the torsional portion and the edge of the rail foot associated with a contact face of the guide plate. It is thus ensured that the end portion, even when an imprecise orientation of the rail foot and guide plate occurs as a result of wear or assembly errors, is always seated on the rail foot over an adequate length to apply the required holding down force.

The advantages of an orientation and shaping of the end portion of a tensioning clamp according to the invention summarised above occur, in particular, when the length of the bent end portion corresponds to at least 20% of the length of the torsional portion. The linear bearing of the end portion on the associated rail foot predetermined according to the invention when the tensioning clamp is completely braced can be brought about in that the end portion is arranged at such a large angle in relation to the remaining part piece of the holding arm with respect to the contact face, taking into account the deformations accompanying the bracing of the tensioning clamp, that the end portion during the bracing rests over its entire length on the surface of the rail foot.

As an alternative or in addition, the holding arm can be formed in such a way that it is only minimally deformed in the course of bracing. This allows the end portion of the holding arm to be oriented from the start in relation to its remaining part piece in such a way that it is already seated when the tensioning clamp is relieved of tension, linearly on the surface of the rail foot. For this purpose, the shaping and orientation of the holding arm is selected such that the holding arm is substantially exclusively used as a lever with low inherent elasticity, so the spring force exerted by the tensioning clamp in the braced state is substantially exclusively produced by torsion of the torsional portion. This can be achieved in that the holding arm is oriented in such a way in relation to the torsional portion that the torsional portion and the holding arm, viewed in a plan view of the tensioning clamp from above, enclose an angle of 80° to 110°, in particular 85° to 95°, an enclosed angle approaching 90° in the scope of manufacturing possibilities producing optimal results.

The stiffness of the holding arm can be optimised in that an arcuate part piece of the holding arm runs in a plane, which the torsional portion passes through at an angle of 80° to 100°. In practice, this orientation of the arcuate part piece of the holding arm can be implemented in that the transitional portion, between the holding arm and the torsional portion, describes an upwardly directed arc when the tensioning clamp is located on a horizontal face, said arc encompassing an angle region of 80° to 110°. With an arcuate configuration of the relevant part piece of the holding arm of a tensioning clamp according to the invention, the holding arm, in a side view in the region of this part piece, has an arcuate or dome-shaped form, by means of which it is ensured that the holding arm even under highly resilient holding down forces, or in the case of a transverse displacement of the rail, retains its shape substantially unchanged. As a result of this, its end portion, in the braced state, also at all times rests in an optimally linear manner on the rail foot.

The concentration of the production of the holding down force on the torsional portion can be additionally assisted in that, viewed in plan view, the centre portion encloses an angle of 80° to 110° with the torsional portion. With this configuration, the centre portion also acts substantially exclusively as a lever for the torsion of the torsional portion, without itself being resiliently yielding.

Tensioning clamps according to the invention can be produced, like the tensioning clamps known from the prior art, in one piece from a spring steel wire, in that they form a curved line bent in a step-free manner.

The storage and handling of a tensioning clamp according to the invention can be simplified in a known manner in that the spacing of the free end of the bent end portion from the centre portion is smaller than the smallest thickness of the centre portion, torsional portion, transitional portion, holding arm and end portion. Loosely mounted tensioning clamps can thus be reliably prevented from hooking into one another.

Obviously, a tensioning clamp according to the invention may be configured mirror-symmetrically like the known tensioning clamps in that the centre portion is formed in a loop-shape and torsional portions oriented in opposite directions to one another branch off from it, a holding arm with a bent end portion being connected to said torsional portions by means of a respective transitional portion. The tensioning clamp according to the invention then has a W-shaped or ω-shaped form.

The concentration aimed for according to the invention of the production of the resilient holding down force on the torsional portion allows a particularly space-saving design of a tensioning clamp according to the invention. According to an advantageous configuration of the invention, the length of the torsional arm is in each case so short in dimension for this purpose that the respective holding arm is guided at least in portions above the guide plate.

According to an advantageous configuration of the invention, in particular from the manufacturing point of view, the end portion of the holding arm is bent relative to the portion of the holding arm adjoining it in such a way that the imaginary extension of the end portion in the assembly position encloses an acute angle of less than 90° with the web of the rail. End portions formed in this way can be particularly economically produced by conventional bending methods on the machines available in practice.

BRIEF DESCRIPTION OF THE DRAWINGS

The invention will be described in more detail below with the aid of drawings showing an exemplary embodiment, in which schematically.

DETAILED DESCRIPTION OF THE INVENTION

Figure 4:
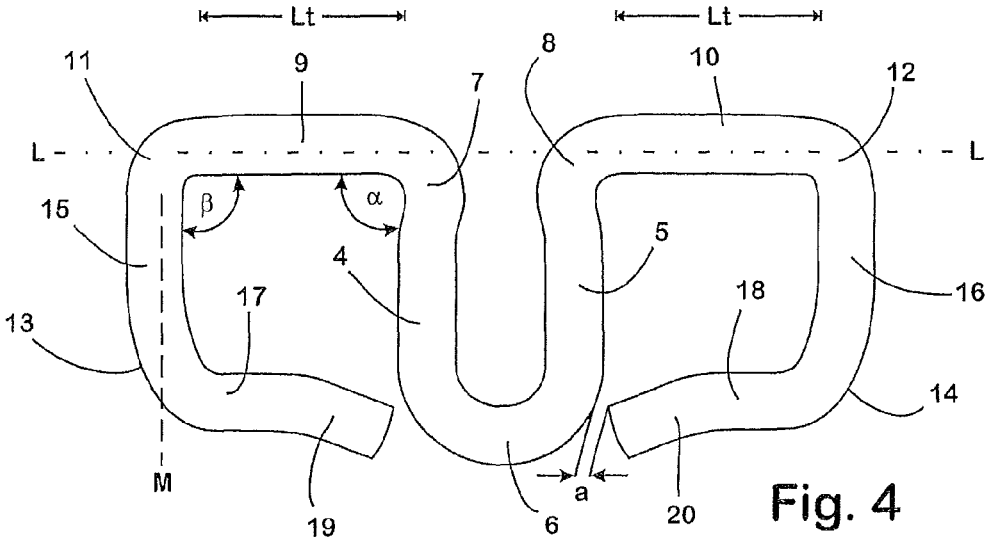
FIG. 4 shows the tensioning clamp according to FIG. 2 in a plan view from above.
Figure 6:
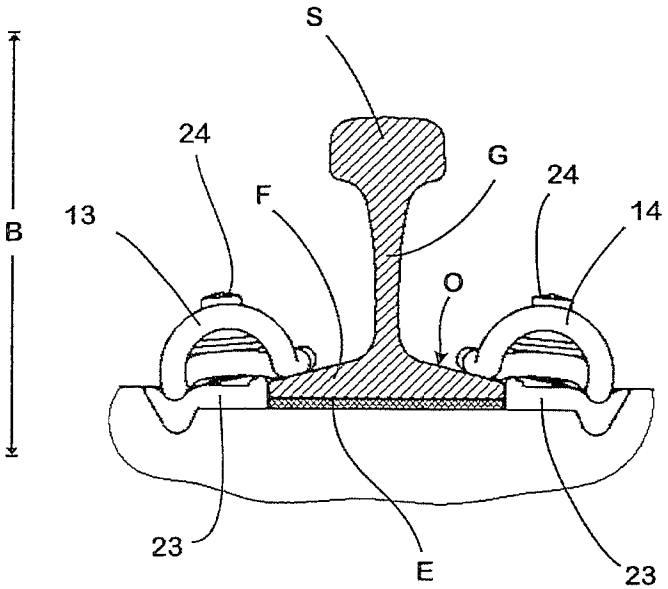
FIG. 6 shows the fastening point according to FIG. 5 in a side, partially sectional view.
Figure 5:
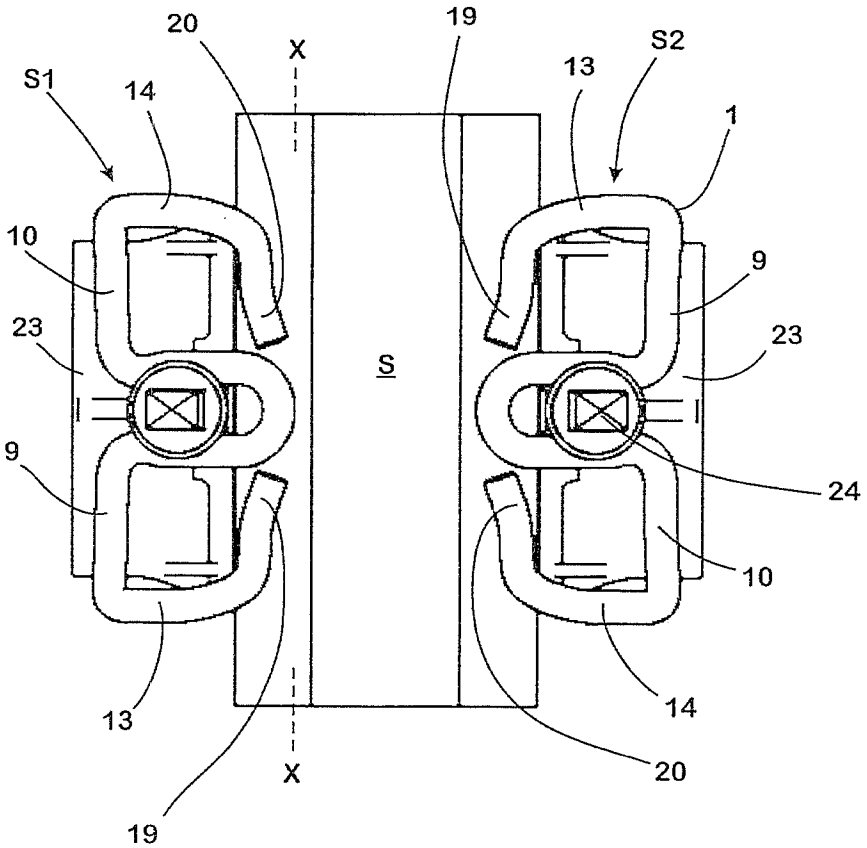
FIG. 5 shows a fastening point formed by two systems for fastening a rail, in a plan view.

The tensioning clamps 1, 50 formed in one piece in a curved line bent in a step-free manner from a spring steel wire for fastening a rail S supported on a base U, formed here, for example, from a concrete sleeper, in relation to a plane N1 oriented normally with respect to the standing face 2 of the base U, are mirror-symmetrical. They, in each case, have a U-shaped centre portion 3 in plan view (FIG. 4), configured in a loop-like manner, with two legs 4, 5 oriented in parallel and spaced apart from one another and a semicircular connecting portion 6 connecting the legs 4, 5 to one another and associated with the rail foot F of the rail S to be fastened.

A torsional portion 9, 10 branching off in the lateral direction is connected in each case to each of the legs 4, 5 of the centre portion 3 by means of a respective transitional portion 7, 8 bent through 90°. The torsional portions 9, 10, in this case point away in opposite directions from the centre portion 3 and, viewed in plan view, enclose an angle α of about 90° with the legs 4, 5 of the centre portion respectively associated with them.

Figure 1:
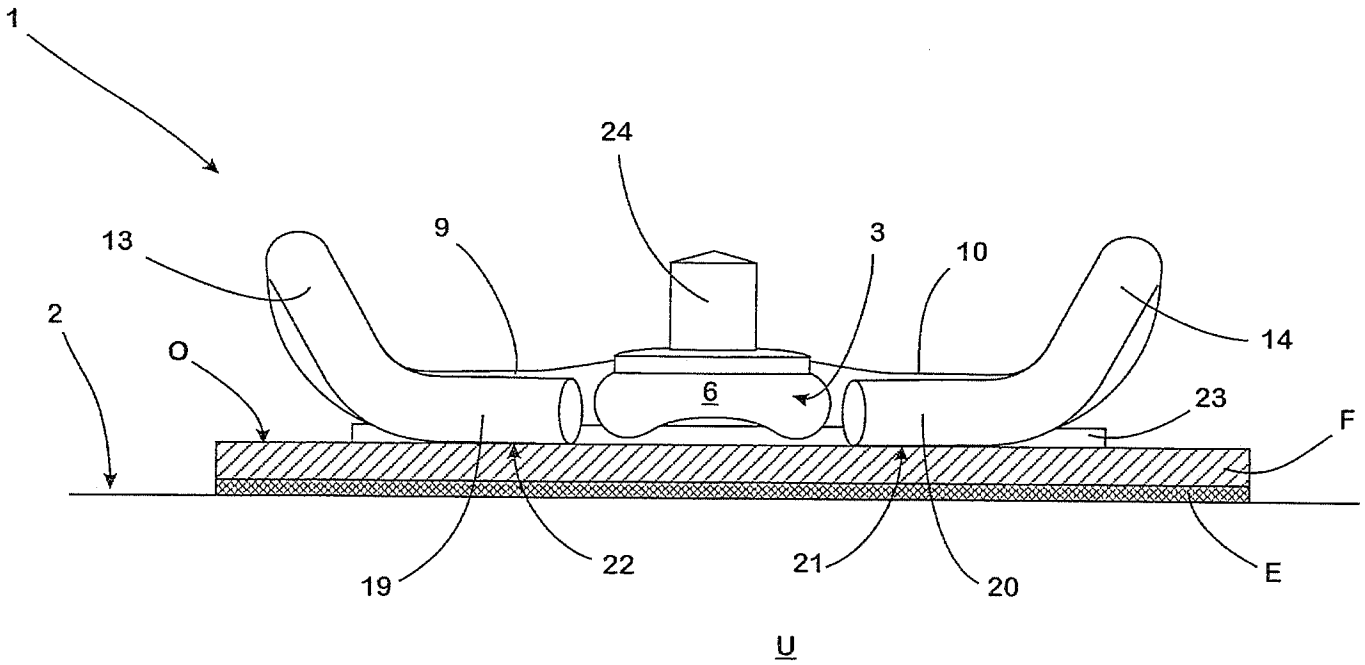
FIG. 1 shows the fastening point shown in FIG. 5 along the sectional line X-X drawn in FIG. 5.
Figure 2:
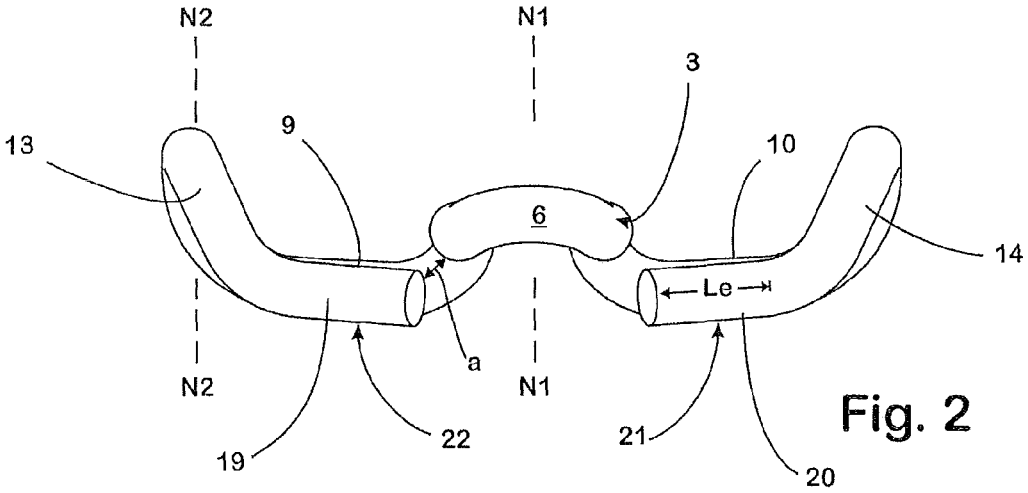
FIG. 2 shows a tensioning clamp used in the system shown in FIGS. 5 and 6 in a view from the front.
Figure 3:
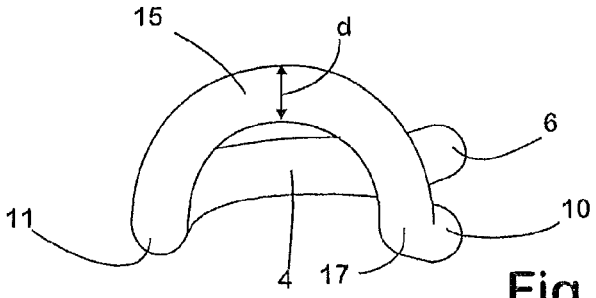
FIG. 3 shows the tensioning clamp according to FIG. 2 in a side view.

Connected to the ends of the torsional portions 9, 10 remote from the centre portion 3, in each case, is a further transitional portion 11, 12, which, when the tensioning clamp 1, 50 is located on its lower side (FIG. 1, 2), leads upwardly in an arc of a circle, which encompasses an angle of about 90°.

The transitional portions 11, 12, in each case pass at their end remote from the respective torsional portion 9, into a holding arm 13, 14, the part piece 15, 16 of which, which is connected to the respective transitional portion 11, 12, viewed in plan view, in each case enclosing an angle β of about 90° with the torsional portion 9, 10 associated with it, so that they are oriented substantially parallel to the legs 4, 5 of the centre portion 3.

The centre axis M of the respective part piece 15, 16 of the holding arms 13, 14 accordingly extends in a plane N2, which is passed through by the common longitudinal axis L of the torsional portions 9, 10, in each case, at an angle of about 90°+/−5°. In this case, the part pieces 15, 16 of the holding arms 13, 14 are bent in the manner of a coupling strut and encompass an angle range of about 180°. At their end remote from the respective torsional portion 9, 10, the part pieces 15, 16 of the holding arms 13, 14 in each case pass in a transitional portion 17, 18 leading through about 90° in the direction of the centre portion 3 and downwardly into a respective end portion 19, 20.

In the tensioning clamp 1 shown in FIGS. 1 to 6, these end portions 19, 20 are bent relative to the respective portion 17, 18 and the respective part piece 15, 16 of the holding arms 13, 14 to point away from the torsional portions 9, 10. The bending and the length of the end portions 19, 20, is in each case selected, taking into account the length of the part portions 15, 16 of the holding arms 13, 14 extending substantially parallel to the legs 4, 5 of the centre portion 3, in such a way that the end portions 19, 20, on the one hand, end at a spacing a from the connecting portion 6 of the centre portion 3, which is smaller than the smallest thickness d of the spring steel, from which the tensioning clamp 1 is bent, and, on the other hand, is oriented in relation to the respective part piece 15, 16 in such a way that the cross sectionally substantially circular end portions 19, 20 in the braced state (FIG. 1) rest with their bearing face 21, 22 extending over their entire length Le linearly on the upper side O of the rail foot F. The inner width of the spacing present between the centre portion 3 and the end portions 19, 20 is consequently so small that no other tensioning clamp 1 can pass through this spacing.

To fasten the rail S on the base U, two identically constructed systems S1, S2 are used, which are assembled on opposing sides of the rail S and in each case comprise a tensioning clamp 1, a guide plate 23 and a tensioning screw 24 required as a tensioning means to tension the tensioning clamp 1.

The guide plate 23 is configured in the embodiment described here in the manner of a conventional angle guide plate and has, on its lower side associated with the base U, a step which extends over its width B measured in the longitudinal direction of the rail S and, when the guide plate 23 is in the assembly position, is seated in a channel provided in the base U and correspondingly formed. In addition, the guide plate in the assembly position is in each case supported with its rear remote from the rail S on a shoulder also formed on the base U. On its front associated with the rail foot F and widened relative to the rear, the guide plate 23 in each case has a contact face, against which the rail foot F is supported by its longitudinal edge. Transverse forces occurring from the rail S when a rail vehicle, not shown, travels over it are thus absorbed by the guide plate 23 and diverted into the base U.

Adjacent to its rear, the guide plate 23, on its upper side, in each case has a channel extending parallel to the contact face of the guide plate 23 as well as additional formed elements, not shown here in detail, to guide the tensioning clamp 1 respectively assembled on the guide plate 23 and a through-opening, also not visible here, leading from the upper side to the base U, through which the tensioning screw 24 is inserted. The tensioning screw 24 is in this case screwed into a pin, not visible here, let into the base U.

The tensioning clamp 1 arranged on the respective guide plate 23 is seated with its torsional portions 9, 10 in the channel of the guide plate 23. The length Lt of the torsional portions 9, 10 is in each case dimensioned such that the holding arms 13, 14 are in each case guided above the guide plate 23 and at least over the widened front region associated with the rail foot F of the guide plate. The width taken up by the tensioning clamps 1 in each case is accordingly only insignificantly larger than the width B of the guide plates 23.

At the same time, the length of the legs 4, 5 of the centre portion 3 are dimensioned such that the tensioning clamp 1, when the tensioning screw is already screwed in but not completely tightened, can be seated in a preassembly position, in which its torsional portions 9, 10 are arranged offset in the direction of the rear of the guide plate 23 and so far outside the channel of the guide plate 23 associated with it that the end portions 19, 20 of the tensioning clamp 1 no longer project into the region provided for the rail S. After the positioning of the rail S, in the space provided for this between the guide plates 23 of the systems S1, S2, the tensioning clamps 1 can then be pushed out of their preassembly position into the end assembly position, in which they rest with their end portions 19, 20 bent in the direction of the web G of the rail S linearly on the upper side O of the rail foot F. The respective tensioning screw 24 is then tightened. In the process, the centre portion 3 of the tensioning clamps 1 is in each case moved in the direction of the base U. As the holding arms 13, 14 are simultaneously supported substantially rigidly on the rail foot F, in the course of the bracing of the tensioning clamps 1, substantially exclusively their torsional portions 9, 10 are twisted. Thus, high spring forces for the elastic holding down of the rail S are provided. These are applied by means of a comparatively large contact face on the rail foot F, so, despite the increased holding down forces, the risk of abrasive wear in the region of the contact between the tensioning clamp 1 and the rail foot F is minimised. In order to also ensure the required yielding property of the support of the rail S in the direction of the base U, an elastic layer E may be provided between the rail foot F and the base in a manner known per se.

If, as a result of wear or unfavourable operating conditions, a displacement of the rail S occurs in the transverse direction Q relative to the tensioning clamps 1, the linear contact is retained and an adequate holding down force continues to be exerted on the rail foot F. This still applies when the transverse displacement goes so far that the respective end portions 19, 20 no longer rest completely on the rail foot F. Owing to the bent orientation of the end portions 19, 20 in the direction of the web, it is ensured even when a gap is produced between the respective guide plate 23 and the rail foot that the end portion 19, 20 bridges this gap and rests on the rail foot F. The linear bearing faces 21, 22 even in this situation allow the rail S to automatically move back again into its starting position without being impeded in this by a tensioning clamp possibly wedging on an indentation produced by abrasive wear on the rail foot F.

Figure 7:
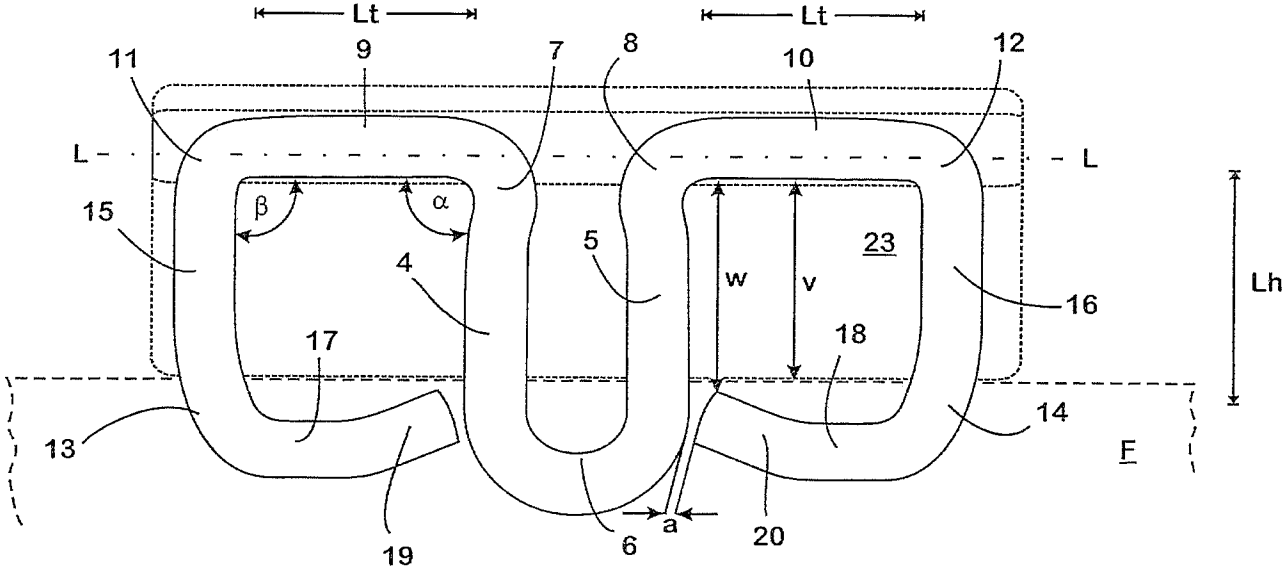
FIG. 7 shows an alternative configuration of a tensioning clamp in a plan view from above corresponding to FIG. 4.

In the tensioning clamp 50 shown in FIG. 7, the end portions 19, 20 are bent relative to the respective transitional portion 17, 18 and the respective part piece 15, 16 of the holding arms 13, 14 pointing in the direction of the respectively associated torsional portion 9, 10, so they point away from the rail web G in the assembly position. The bend and the length of the end portions 19, 20 is also selected here, taking into account the length of the part pieces 15, 16 of the holding arms 13, 14 extending substantially in parallel with the legs 4, 5 of the centre portion 3 in such a way that the end portions 19, 20, on the one hand, end at a spacing a from the connecting portion 6 of the centre portion 3, which is smaller than the smallest thickness d of the spring steel, from which the tensioning clamp 50 is bent. At the same time, in the tensioning clamp 50, the length Lh of the holding arms 13, 14 measured transverse to the longitudinal extent of the rail and to the longitudinal axis L is dimensioned such that in the new state when the system is completely assembled, the smallest spacing w between the respective torsional portion 9, 10 extending axially parallel to the longitudinal axis L and the respectively associated end portion 19, 20 is greater than the spacing v between the edge of the rail foot F associated with the respective guide plate 23 and the relevant torsional portion 9, 10 (the guide plate 23 and the rail foot F are indicated in FIG. 7 for the sake of clearness only by dashed lines). This dimensioning of the holding arms 13, 14 ensures that the end portions 19, 20, despite their form bent in the direction of the respectively associated torsional portion 9, 10, at least in the new state, are supported over the entire length Le of their respective bearing face 21, 22 on the rail foot F. If, as a result of wear, a displacement of the rail S relative to the guide plate 23 occurs, in the tensioning clamp 50, the end portions 19, 20 always also remain supported on the rail foot F over a length adequate for reliable force transmission.

LIST OF REFERENCE NUMERALS

1, 50 Tensioning clamps
2 Standing face of the base U
3 Centre portion of the respective tensioning clamp 1, 50
4, 5 Legs of the respective tensioning clamp 1, 50
6 Connecting portion of the centre portion 3
7, 8 Transitional portions of the respective tensioning clamp 1, 50
9, 10 Torsional portions of the respective tensioning clamp 1, 50
11, 12 Transitional portions of the respective tensioning clamp 1, 50
13, 14 Holding arms of the respective tensioning clamp 1, 50
15, 16 Part pieces of the holding arms of the respective tensioning clamp 1, 50
17, 18 Transitional portions of the respective tensioning clamp 1, 50
19, 20 End portions of the respective tensioning clamp 1, 50
21, 22 Bearing face of the respective tensioning clamp 1, 50
23 Guide plates
24 Tensioning screws
a Spacing
B Width of the guide plates 23
d Thickness of the spring steel of the respective tensioning clamp 1, 50
E Elastic layer
F Rail foot of the rail S
G Web of the rail S
L Longitudinal axis of the torsional portions 9, 10
Le Length of the end portions 19, 20
Lt Length of the torsional portions 9, 10
Lh Length of the holding arms 13, 14
M Centre axis of the part pieces 15, 16

N1 Plane
N2 Plane
O Upper side of the rail foot F
S Rail
S1, S2 Systems for fastening a rail
U Base
w Smallest spacing between the torsional arms 9, 10 of the tensioning clamp 50 and the end portion 19, respectively associated with them
v Spacing between the torsional arms 9, 10 of the tensioning clamp 50 and the edge of the rail foot respectively associated with them
α Angle
β Angle

The invention claimed is:

1. A tensioning clamp for fastening a rail comprising a center portion, at least one torsional portion branching off from the center portion in a lateral direction, at least one transitional portion adjoining the torsional portion, at least one holding arm which is connected to the transitional portion and an end portion associated with a free end of the holding arm is oriented bent in relation to the torsional portion viewed in a plan view of the tensioning clamp, and a bearing region extending over an entire length of the end portion of the holding arm, wherein the end portion is bent in relation to a part piece of the holding arm adjoining the holding arm in such a way that when the tensioning clamp is completely assembled, the bearing region, over an entire length of the bearing region, rests linearly on an associated surface of the rail foot of a rail to be fastened, wherein the end portion is aligned such that the end portion points against an outer side of the center portion and wherein the end portion, viewed in a plan view of the tensioning clamp, is bent to point away from the torsional portion in such a way that the end portion is directed, in an assembly position, toward a rail web of the rail to be fastened.

2. The tensioning clamp according to claim 1, wherein the holding arm and the torsional portion, viewed in a plan view, enclose an angle of 80° to 110°.

3. The tensioning clamp according to claim 2, wherein the angle enclosed by the holding arm and the torsional portion, viewed in plan view, is 85° to 95°.

4. The tensioning clamp according to claim 1, wherein the holding arm comprises an arcuate part piece extending in a plane, which the torsional portion passes through at an angle of 80° to 100°.

5. The tensioning clamp according to claim 1, wherein viewed in a plan view, the centre portion encloses an angle of 80° to 110° with the torsional portion.

6. The tensioning clamp according to claim 1, wherein the end portion, viewed in a plan view of the tensioning clamp, is bent to point to the torsional portion in such a way that, in an assembly position, the end portion points away from a rail web of the rail to be fastened.

7. The tensioning clamp according to claim 1, wherein the length of the end portion corresponds to at least 20% of a length of the torsional portion.

8. The tensioning clamp according to claim 1, comprising a curved line bent in a continuous manner formation.

9. The tensioning clamp according to claim 1, wherein a spacing of the free end of the end portion from the center portion is smaller than a minimum thickness of the center portion, the torsional portion, the transitional portion, the holding arm and the end portion.

10. The tensioning clamp according to claim 1, comprising a mirror-symmetrical formation, wherein the center portion is formed in a loop shape and two torsional portions oriented in opposite directions to one another branch off from the center portion, to which a respective holding arm with a respective end portion is connected by means of a respective transitional portion.

11. A system for fastening a rail, which has a rail foot, a web standing thereon and a rail head, with a guide plate, a tensioning clamp held on the guide plate and a tensioning means for bracing the tensioning clamp against a base supporting the rail, wherein the tensioning clamp comprises the tensioning clamp according to claim 1.

12. The system according to claim 11, wherein a length of the torsional portion is, in each case, dimensioned such that the respective holding arm, in an assembly position, is guided, at least in portions, above the guide plate.

13. The system according to claim 11, wherein the end portion of the holding arm is bent in such a way that an axis of the end portion, in an assembly position, forms an acute angle with the web of the rail.

14. The system according to claim 11, wherein a smallest spacing between the torsional portion and the end portion associated with the torsional portion is greater than a minimum spacing between the torsional portion and an edge of the rail foot associated with a contact face of the guide plate.

15. A system for fastening a rail, which has a rail foot, a web standing thereon and a rail head, with a guide plate, a tensioning clamp held on the guide plate and a tensioning means for bracing the tensioning clamp against a base supporting the rail, wherein the tensioning clamp comprises the tensioning clamp according to claim 1, and wherein the end portion of the holding arm is bent in such a way that an axis of the end portion, in an assembly position, forms an acute angle with the web of the rail.

16. A tensioning clamp for fastening a rail comprising a center portion, at least one torsional portion branching off from the center portion in a lateral direction, at least one transitional portion adjoining the torsional portion, at least one holding arm which is connected to the transitional portion and an end portion associated with a free end of the holding arm is oriented bent in relation to the torsional portion viewed in a plan view of the tensioning clamp, and a bearing region extending over an entire length of the end portion of the holding arm, wherein the end portion is bent in relation to a part piece of the holding arm adjoining the holding arm in such a way that when the tensioning clamp is completely assembled, the bearing region, over an entire length of the bearing region, rests linearly on an associated surface of the rail foot of a rail to be fastened, wherein the end portion is aligned such that the end portion points against an outer side of the center portion and wherein the end portion, viewed in a plan view of the tensioning clamp, is bent to point away from the torsional portion in such a way that the end portion is directed, in an assembly position, toward a rail web of the rail to be fastened, and wherein a spacing of the free end of the end portion from the center portion is smaller than a minimum thickness of the center portion, the torsional portion, the transitional portion, the holding arm and the end portion.

* * * * *